US005515252A

United States Patent [19]

Osteen et al.

[11] Patent Number: 5,515,252

[45] Date of Patent: May 7, 1996

[54] UNIVERSAL COVER PLATE FOR A LIGHTING FIXTURE

[75] Inventors: Mitchell M. Osteen, Zirconia; Suleyman O. Sumer, Chapel Hill, both of N.C.

[73] Assignee: Regent Lighting Corporation, Burlington, N.C.

[21] Appl. No.: 106,938

[22] Filed: Aug. 16, 1993

[51] Int. Cl.[6] ..... F21S 1/02

[52] U.S. Cl. ..... 362/147; 362/404; 362/427; 362/457; 248/343; 248/344; 248/263

[58] Field of Search ..... 362/147, 404, 362/249, 250, 408, 427, 269, 287, 382, 145, 148, 150, 252, 364, 263, 457; 361/600; 248/906, 342, 343, 344; 220/3.8

[56] References Cited

U.S. PATENT DOCUMENTS 4,302,798 11/1981 Sit ..... 362/147
4,356,540 10/1982 Goralnik ..... 362/147
4,507,719 3/1985 Quioque ..... 362/404
5,258,899 11/1993 Chen ..... 362/421 X
5,335,159 8/1994 Chen ..... 362/421

*Primary Examiner*—Ira S. Lazarus
*Assistant Examiner*—Thomas M. Sember
*Attorney, Agent, or Firm*—Rhodes, Coats & Bennett

[57] ABSTRACT

A cover plate is designed for use in either wall mounting or ceiling mounting applications. The cover plate comprises a base forming a base plane for mounting said plate flush against a support surface. A main body is connected to the base and has a generally flat mounting surface disposed in the plane parallel to the base and a sloped mounting surface inclined with respect to the base plane. A pair of first mounting holes are formed in the flat mounting surface which have an axis substantially perpendicular to the base plane. A pair of second mounting holes are formed in the sloped mounting surface and have an axis disposed at an angle with respect to the base plane. In ceiling mounting applications, lighting fixtures are received in the first mounting holes. Conversely, in wall mounting applications, the lighting fixtures are received in the second mounting holes.

18 Claims, 10 Drawing Sheets

UNIVERSAL COVER PLATE FOR A LIGHTING FIXTURE

FIELD OF THE INVENTION

The present invention relates generally to outdoor lighting fixtures. More particularly, the present invention relates to a cover plate for outdoor lighting fixtures.

BACKGROUND OF THE INVENTION

Cover plates for outdoor lighting fixtures typically have a semi-spherical surface or a pyramidal with two or three holes for mounting lighting fixtures. (See FIGS. 9 & 10) Such cover plates are used in both wall mounting and ceiling mounting applications. A problem arises when using these plates for mounting quartz halogen lamps in ceiling mounting applications. The quartz tubes in the lamp must be maintained horizontal during operation. If the quartz tube is not kept horizontal, the useful life of the lamp is decreased. In ceiling mounting applications, the slope of the cover plate causes the quartz tubes in the lamps to be tilted from horizontal. Thus, it is not recommended to use the cover plates in ceiling mounting applications. Further, it is not practical to stock separate cover plates for wall mounting applications and ceiling mounting applications.

Another problem with conventional cover plates is that the cover plate has no means for adjustment. The cover plate is fixed to the junction box in only one position by a pair of screws which does not allow for any adjustment. In a wall mounted application, if the junction box is not installed with the support bracket perfectly aligned, then the quartz lamp tubes cannot be properly horizontally disposed.

SUMMARY AND OBJECTS OF THE INVENTION

The present invention provides a universal cover plate for quartz halogen lamps which can be used in either wall mounting or ceiling mounting applications. The cover plate comprises a base and a main body having central section and two side sections. The central section includes a flat mounting surface which is disposed parallel to the support surface. The side sections have a generally spherical configuration and slope downwardly from the central section. A first set of mounting holes is formed in the flat mounting surface of the central section to be used for ceiling mounting applications. A second set of mounting holes is formed in the spherical-side sections to be used in wall mounting applications.

Also, a unique mounting bracket is first attached to the conventional junction box for connecting the cover plate to the junction box. The cover plate has a single center hole that aligns with a threaded hole in the mounting bracket. The cover plate is fixed to the bracket with a screw. The screw can be loosened to allow adjustment of the angular position of the cover plate and then retightened to hold the cover plate in the desired position. The cover plate can thus be rotated to ensure horizontal alignment of the mounting holes. This feature ensures horizontal disposition of the quartz tube and provides greater flexibility in adjusting the lighting fixtures to illuminate a desired area.

The improved cover plate design of the present invention can add the benefits described above without increasing the cost of producing the cover plate. The cover plate is manufactured using the same methods and techniques as prior art cover plates, and does not require any extra machining operations. Further, the cover plate improves efficiency and operation by eliminating the need to manufacture and stock two different cover plates for wall mounting and ceiling mounting applications.

Other objects and advantages of the present invention will become apparent and obvious from a study of the following description and the accompanying drawings which are merely illustrative of such invention.

DETAILED DESCRIPTION OF THE INVENTION

Figure 1:
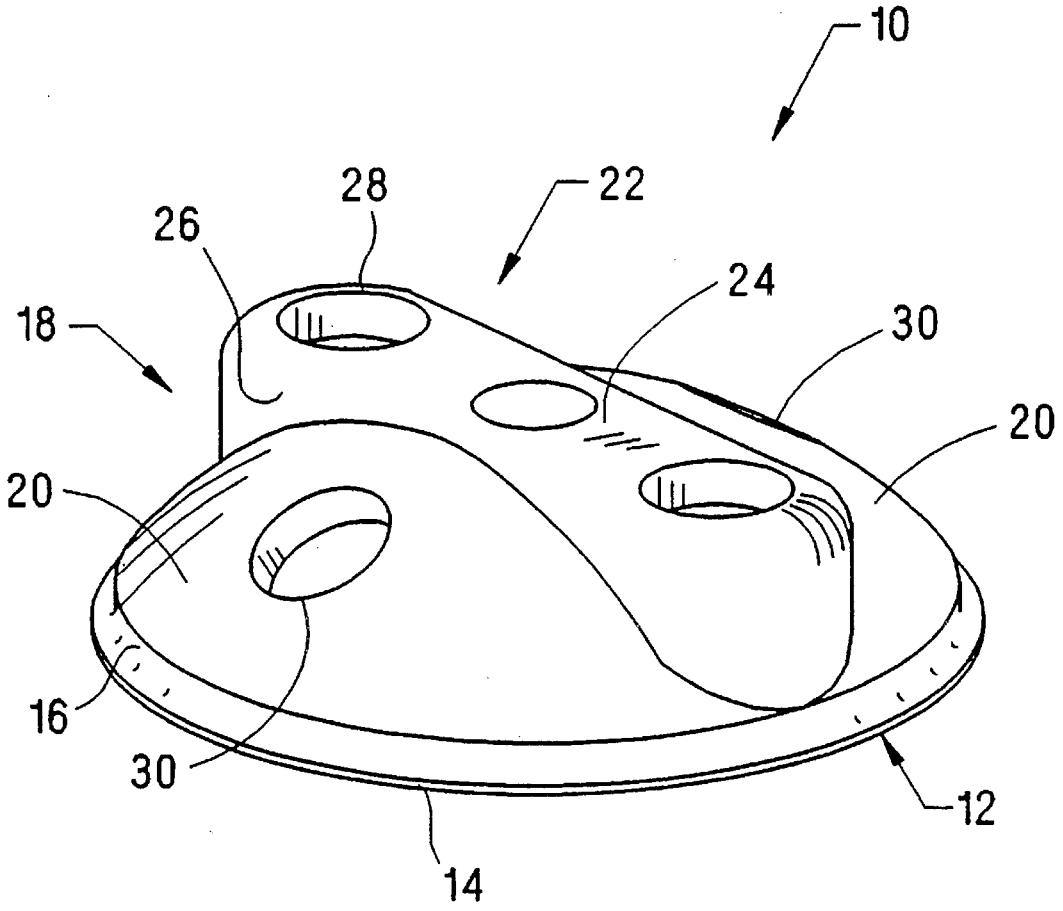
FIG. 1 is a perspective view of the universal cover plate of the present invention.

Referring now to the drawings, the universal cover plate of the present invention is shown therein and indicated generally by the numeral 10. The cover plate 10 is preferably cast from aluminum or other metal. The cover plate 10 can also be molded from plastic.

The cover plate 10 has a generally circular configuration and includes a base 12 and a main body 18. The base 12 includes a circular base wall 16 and an outwardly projecting flange 14 which lies in base plane. The flange 14 of the base 12 is adapted to mount against a support surface, such as a wall or ceiling, with the aforesaid base plane being coplanar with the support surface.

The main body 18 includes a central section 22 and two side sections 20. The side sections 20 extend from the top of the base wall 16 and preferably have a generally spherical configuration. The central section 22 extends diametrically along a center line of the main body 18. The central section 22 includes vertical support walls 26 and a flat mounting surface 24 that lies parallel to the base plane. The side sections 20 slope outwardly from the central section 22 and connect to the base wall 16. The side sections 20 have a generally spherical configuration.

Figure 2:
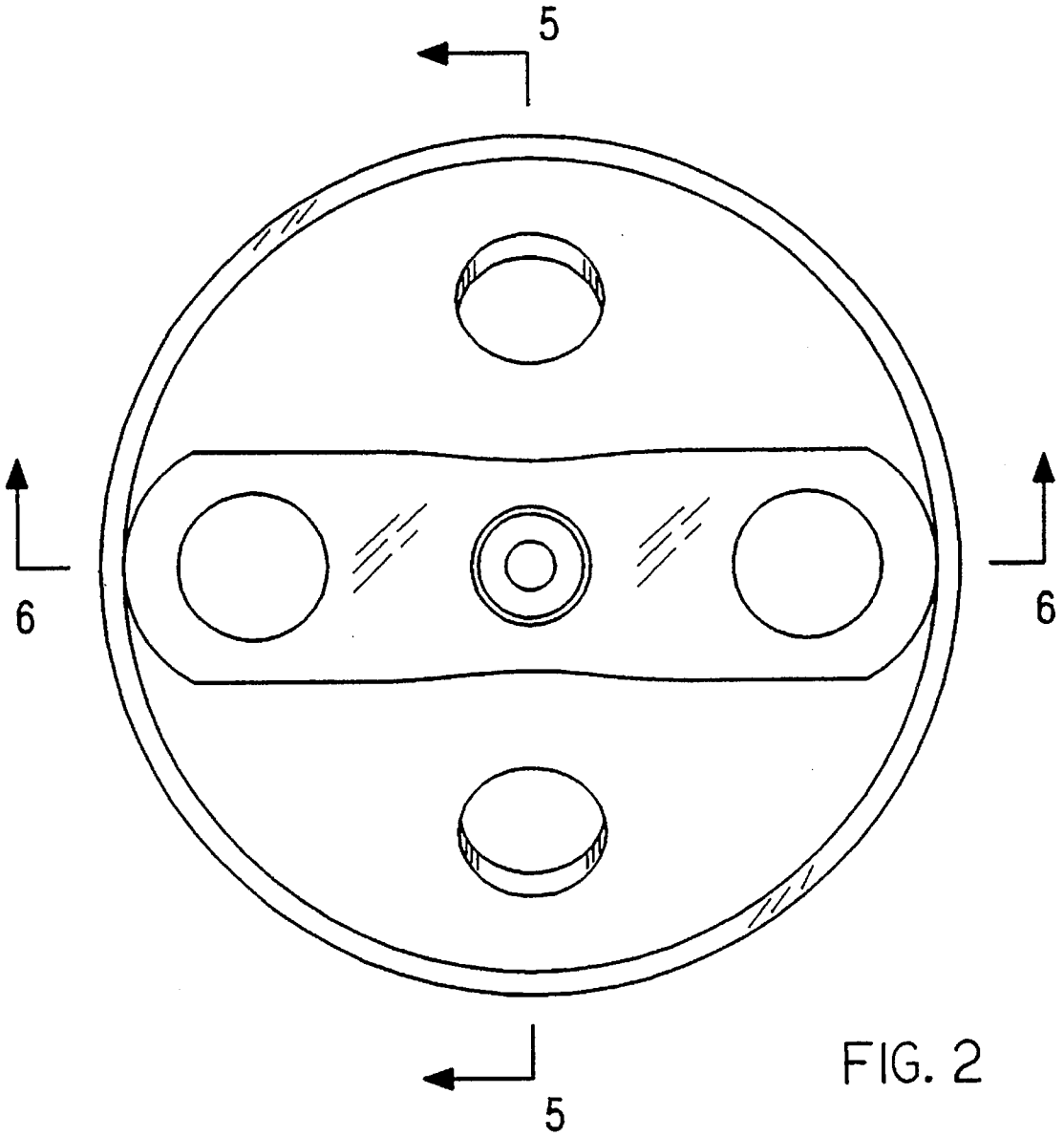
FIG. 2 is a top plan view of the universal cover plate.
Figure 3:
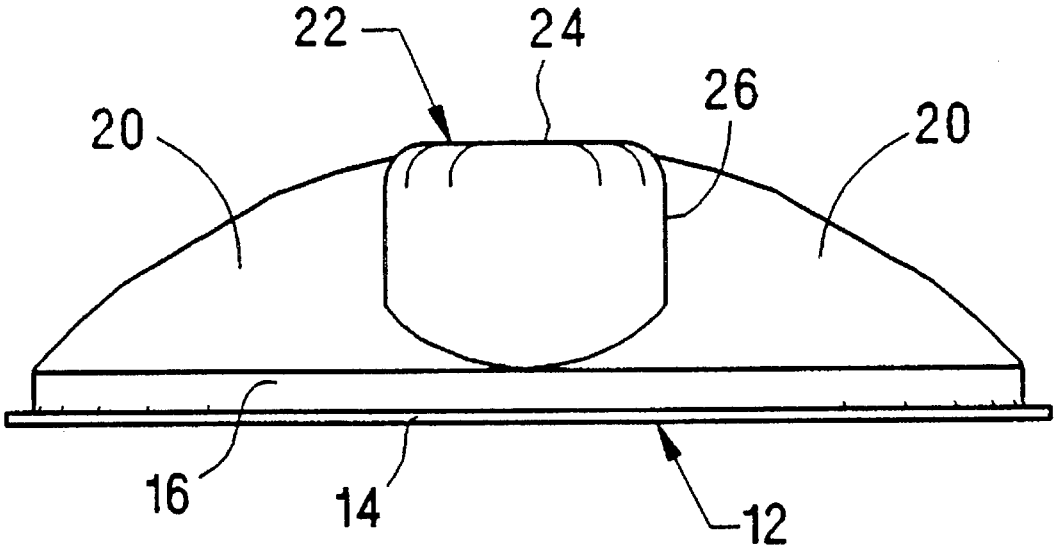
FIG. 3 is a front elevation of the universal cover plate.
Figure 4:
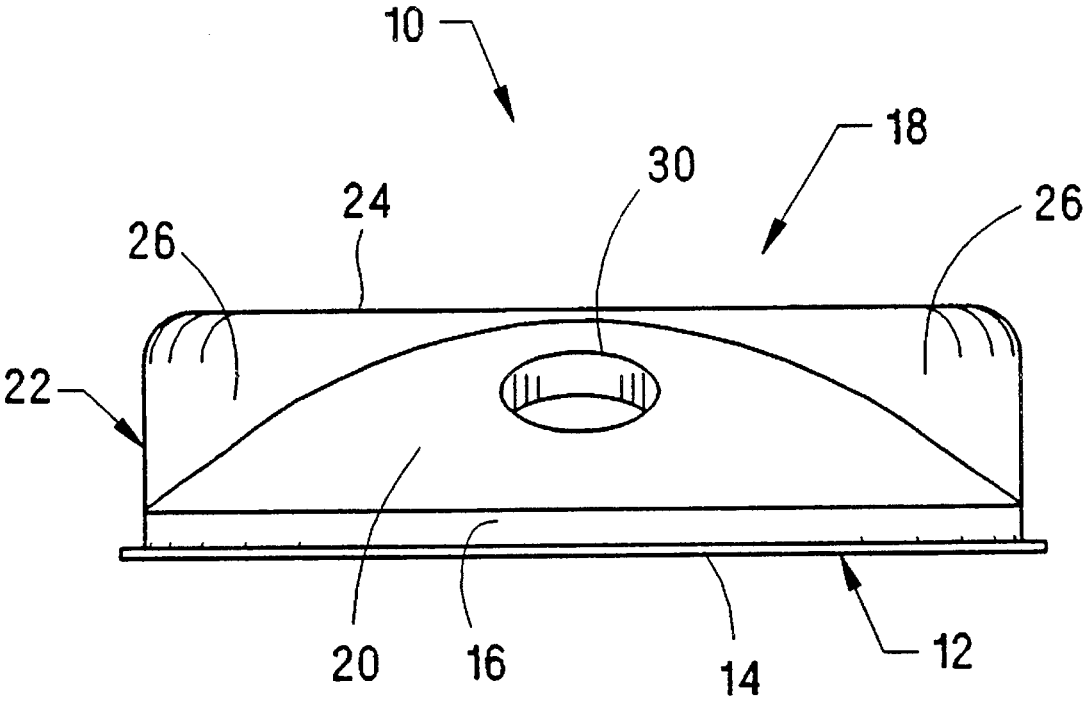
FIG. 4 is a side elevation of the universal cover plate.

A first set of threaded mounting holes 28 are formed in the flat mounting surface 24 at opposite ends of the central section 22 along a first centerline as seen in FIG. 2. The axis of the first mounting holes 28 is substantially perpendicular to the base plane of the cover plate. The first set of mounting holes 28 are used for mounting lighting fixtures in ceiling mounting applications.

A second set of threaded mounting holes 30 for wall mounting applications are formed in respective side sections 20 on opposite sides of the central section 22. The second mounting holes 30 are disposed along a second center line which is disposed at substantially a 90° angle to the first center line. The axis of the second mounting holes 30 is disposed at a prescribed angle relative to the base plane of the cover plate 10. An angle of approximately 60° with respect to the base plane (FIG. 5).

Figure 5:
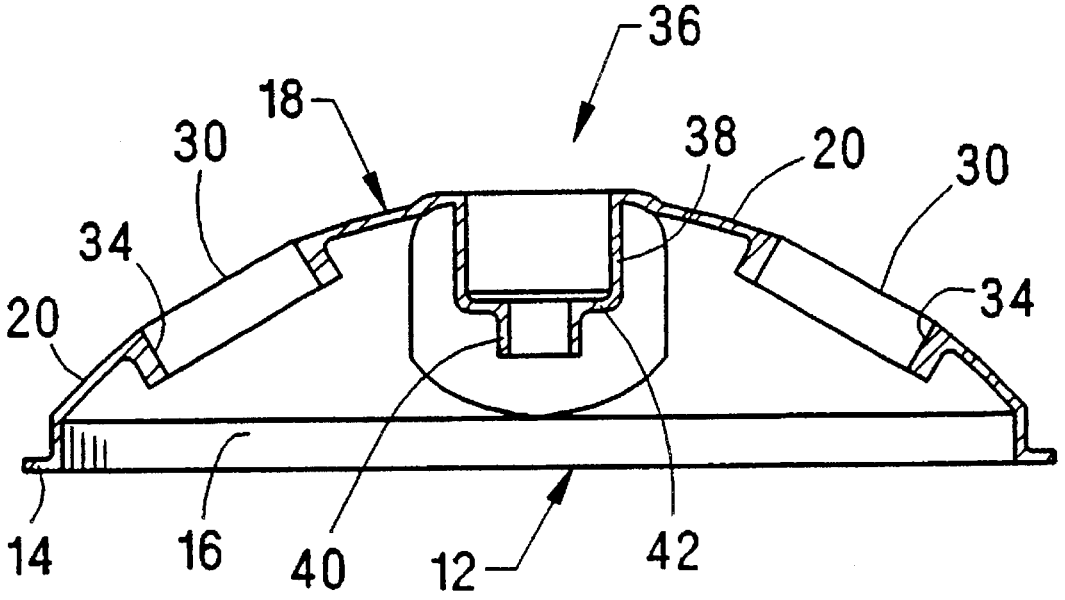
FIG. 5 is a section view of the universal cover plate taken through line 5—5 of FIG. 2.
Figure 6:
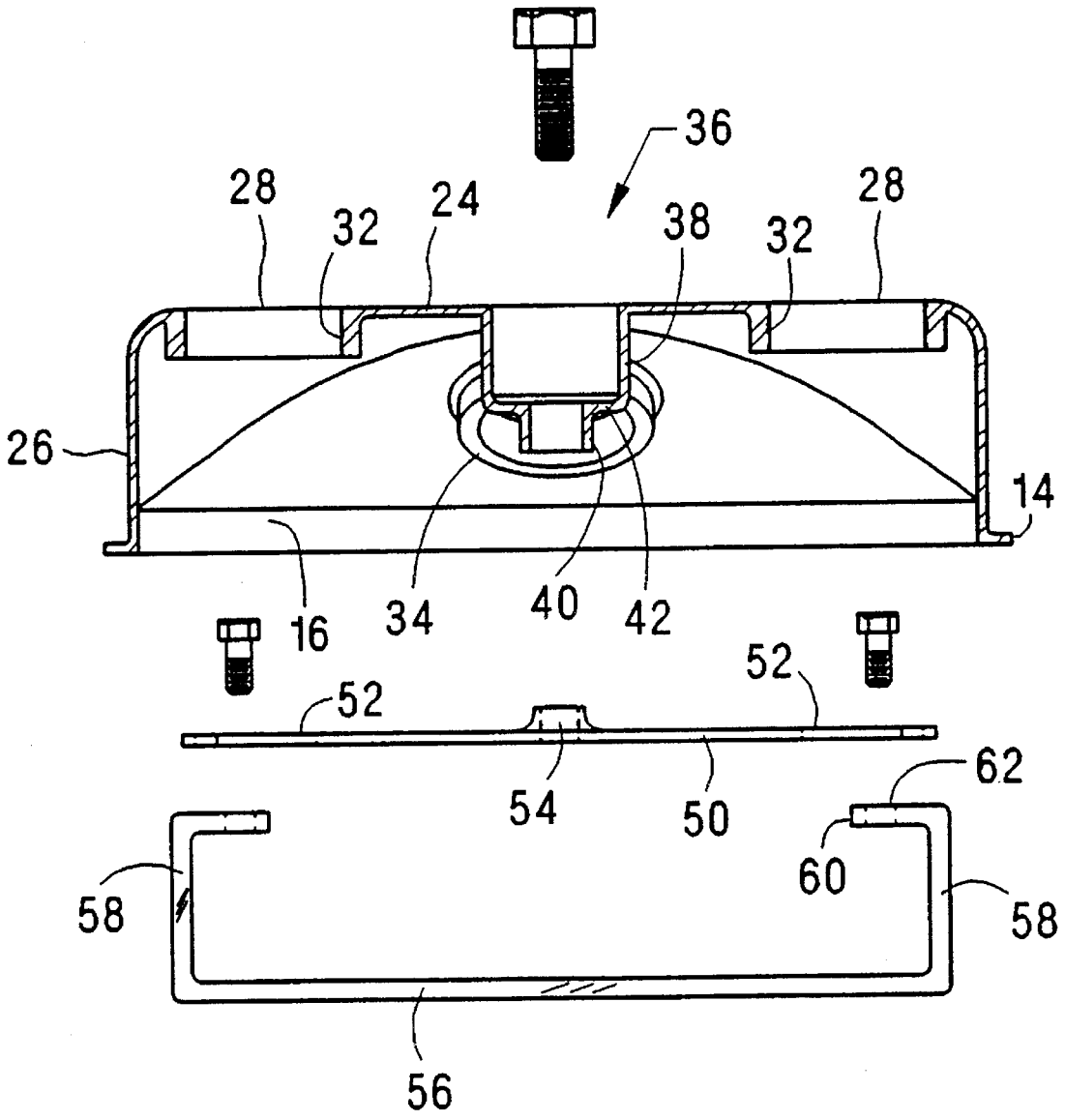
FIG. 6 is a section view of the universal cover plate taken through line 6—6 of FIG. 2.
Figure 7:
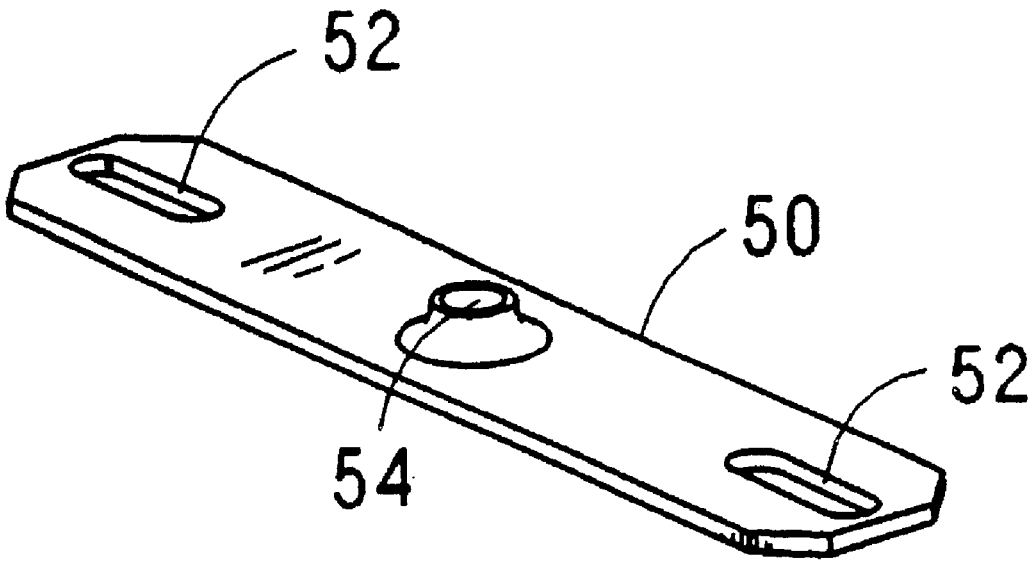
FIG. 7 is a perspective view of the mounting bracket for the universal cover plate.

Inwardly projecting reinforcing walls 32, 34 surround first and second mounting holes 28 and 30 respectively as most clearly seen in FIGS. 5 and 6. The reinforcing walls 32, 34 provide a large surface area for forming threads in the mounting holes 28 and 30. Additionally, the reinforcing walls increase the strength of the cover plate 10.

The cover plate 10 includes a center hole 36 which is formed in the central section 22 for mounting the cover plate 10 to a junction box 56 (FIG. 6). The center hole 36 includes a large upper section 38 and a small lower section 40. A seat 42 for a bolt or screw is formed between the upper and lower sections 38 and 40.

The cover plate 10 is assembled to the junction box 56 by a unique support bracket 50. The bracket 50 comprises an elongated plate having a pair of slots 52 at opposite ends thereof. A threaded center hole 54 is formed in the center of the bracket.

The bracket 50 mounts to the junction box 56 as shown in FIG. 6. The junction box 56 includes upstanding walls 58 and an inwardly projecting flange 60. The inwardly projecting flange 60 includes threaded holes 62 on opposite sides thereof which are normally used for securing a conventional cover plate. In the present invention, the bracket 50 is secured to the junction box 56 by screws which pass through the slotted holes 52 in the bracket 50 and threadably engage the conventionally existing holes 62 in the junction box. The cover plate 10 is then secured to the bracket 50 by a large screw or nipple which is inserted through the center hole 36 in the cover plate 10 and threadably engages the threaded opening 54 in the bracket 50. When the screw is tightened, the cover plate 10 is held in a fixed position. The angular position of the cover plate 10 can be adjusted by loosening the screw, rotating to cover plate 10 to a new position, and the retightening the screw. By providing means for adjusting the angular position of the cover plate 10, greater flexibility is given in focusing the light in a desired location.

Figure 8:
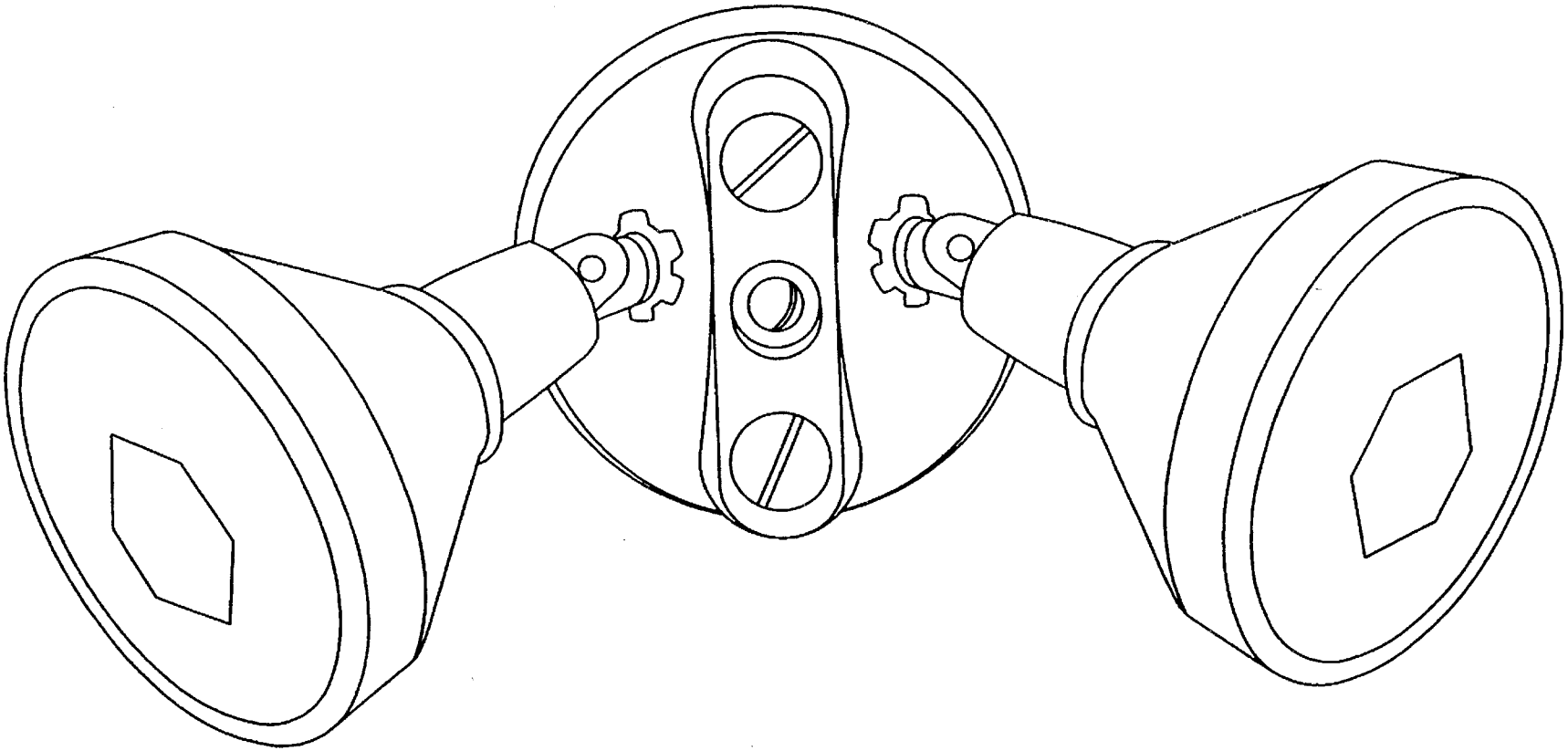
FIG. 8 is a perspective view of the universal cover plate showing lighting fixtures mounted in a wall-mounting application.
Figure 9:
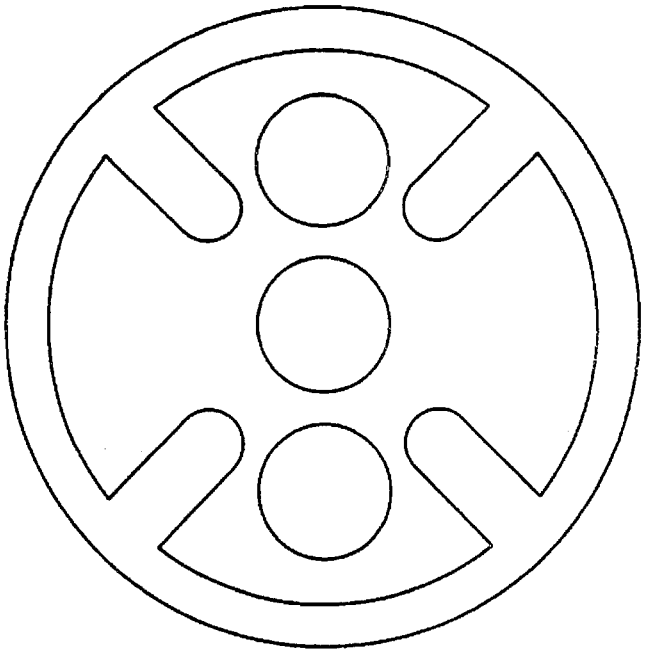
FIG. 9 PRIOR ART
FIG. 9 is a plan view of a spherical cover plate.
Figure 10:
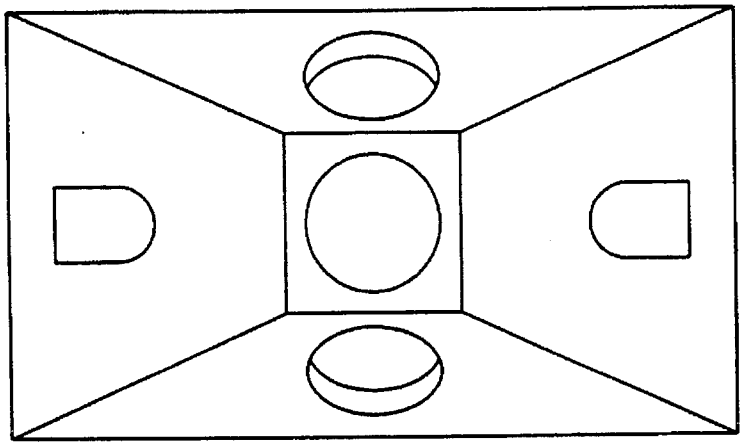
FIG. 10 PRIOR ART
FIG. 10 is a plan view of a pyramidal cover plate.
Figure 11:
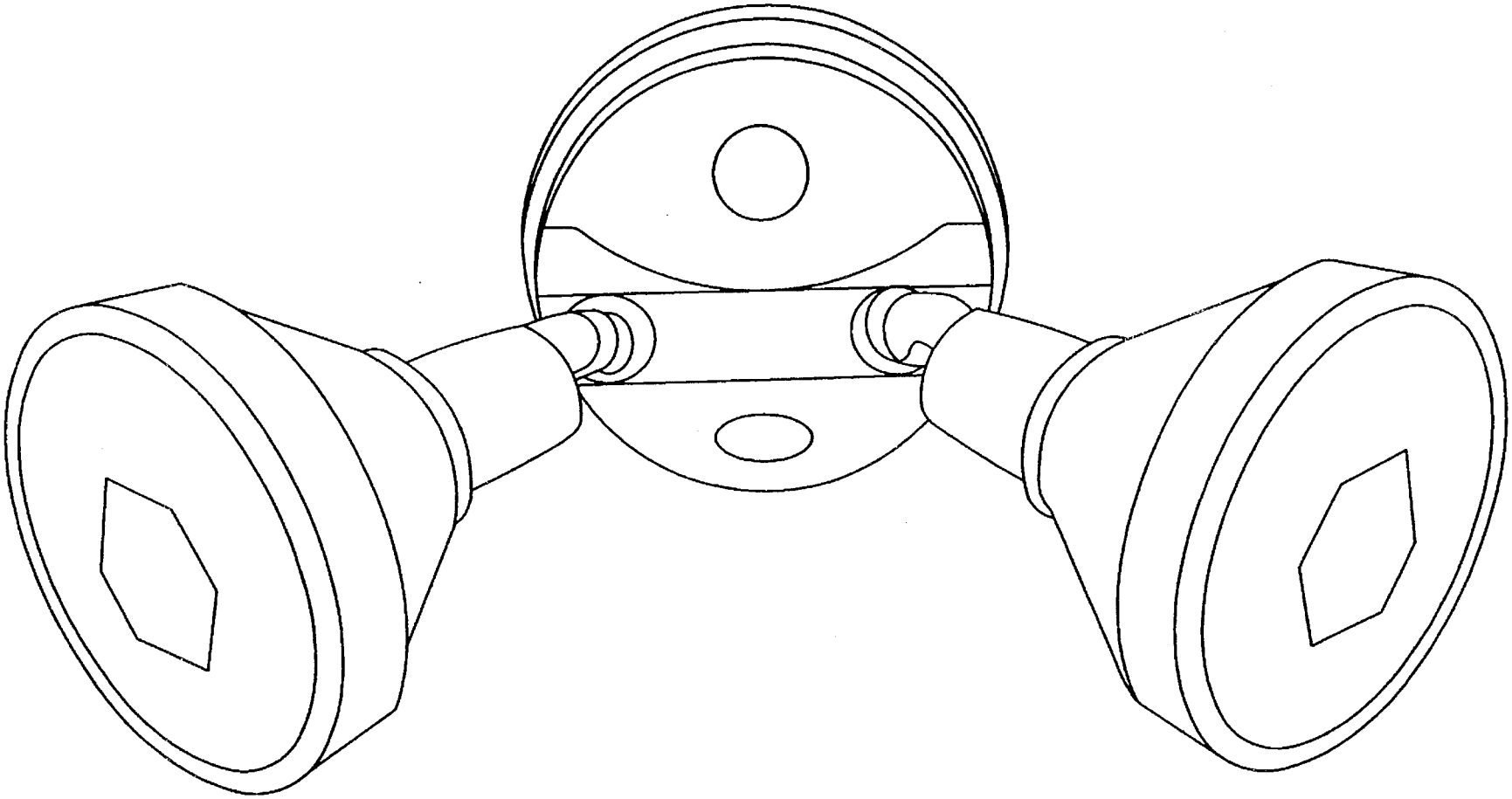
FIG. 11 is a perspective view of the universal cover plate showing lighting fixtures mounted in a ceiling mounting application.

In use, it is typical to mount two lighting fixtures to the cover plate 10. The lighting fixtures are mounted to the cover plate 10 by screwing the lighting fixtures into either the mounting holes 28 and 30. If the cover plate is mounted to a wall, as shown in FIG. 8, the lighting fixtures are threaded into the second mounting holes 30 in the spherical side sections 20. Conversely, if the cover plate 10 is mounted to a ceiling, the lighting fixtures are threaded into the first set of mounting holes 28 in the central section 22. The non-used holes, 28 or 30, or additional holes, can be used for other devices such as motion detectors.

By providing a flat mounting surface in the central section 22, it is possible to adjust the lighting fixtures so as to maintain the quartz tubes in a generally horizontal position in ceiling mounting applications. Also, the single, center screw allows the cover plate 10 to be rotated to a desired position.

The ability of the cover plate of the present invention to maintain the quartz tube in a generally horizontal position can be appreciated by considering a typical quartz halogen lighting fixture. The lighting fixture has an axis extending generally through its center from end-to-end (i.e., from the mounting coupling to the lens). The axis of the linear quartz tube is transverse to the axis of the lighting fixture. A pivot point is provided between the mounting coupling and the quartz tube, the axis of the pivot being parallel to the axis of the quartz tube.

If a pair of lighting fixtures are wall mounted, the angles of spherical side sections 20 position each lighting fixture to provide light generally away from the wall, one to each side. The pivot point allows up and down angular adjustments of the lighting fixture. If the lighting fixture is initially installed such that the quartz tube is horizontally aligned with respect to the ground, the upward and downward adjustment will not affect the horizontal alignment.

If the lighting fixtures are mounted on a ceiling, a problem is encountered if the cover plate of the prior art or the side spherical sections of the cover plate of the present invention are used. Typically, when a lighting fixture is mounted on a ceiling or eave, it is desired to direct the light away from an adjacent wall. Thus, the lighting fixtures must be pointed in a generally forward direction with respect to the wall, as for the wall mounted application. If one attempts to direct the lighting fixtures such that they are facing other than in opposite directions, one or both of the tubes will not be horizontally aligned with respect to the ground. By contrast, one may install the lighting fixtures in the cover plate of the present invention as described above. One or both lighting fixtures may be positioned in their respective holes 28 such that they face generally forward with respect to the adjacent wall. The axis of the pivot is parallel to the base plane, thereby assuring that the quartz tube, which is also disposed parallel to the axis of the pivot, will remain horizontally aligned with respect to the ground for any upward or downward adjustment of the lighting fixture.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A cover plate for a lighting fixture comprising:

a) a base forming a base plane for mounting said plate flush against a support surface;

b) a main body connected to the base having a generally flat mounting surface disposed in a plane parallel to the base plane and a sloped mounting surface inclined with respect to the base plane;

c) a first mounting hole formed in the flat mounting surface and having an axis substantially perpendicular to said base plane, said first mounting hole arranged and configured to receive said lighting fixture during ceiling mounting applications; and d) a second mounting hole formed in the sloped mounting surface and having an axis disposed at a prescribed angle with respect to said base plane, said second mounting hole arranged and configured to receive said lighting fixture during wall mounting applications.

2. The cover plate of claim 1 further including means for rotatably mounting the cover plate to a conventional junction box such that the cover plate can be angularly adjusted relative to the junction box.

3. The cover plate of claim 2 wherein the mounting means includes a mounting bracket for mounting to the junction box and a screw rotatably journaled in the main body and which threadably engages a threaded opening in the mounting bracket.

4. The cover plate of claim 1 wherein the axis of the second mounting hole is disposed at approximately a 60° angle relative to the base plane.

5. A cover plate for a lighting fixture comprising:

a) a base having a base plane for selectively mounting on a wall and on a ceiling;

b) a main body connected to the base;

c) a pair of first mounting holes formed in the main body arranged and configured to mount said lighting fixtures in ceiling mounting applications, said first mounting holes having an axis generally perpendicular to the base plane; and d) a pair of second mounting holes formed in the main body arranged and configured to mount said lighting fixtures in wall mounting applications, said second mounting holes having an axis disposed at a prescribed angle with respect to the base plane.

6. The cover plate of claim 5 wherein the first mounting holes are disposed along a first centerline.

7. The cover plate of claim 6 wherein the second mounting holes disposed along a second centerline.

8. The cover plate of claim 7 wherein the first and second centerlines are disposed at 90° with respect to one another.

9. The cover plate of claim 5 wherein the axis of the second pair of mounting holes forms an angle of approximately 60° with respect to the base plane.

10. The cover plate of claim 5 wherein the main body includes a generally flat mounting surface disposed in the plane parallel to the base plane in which the first set of mounting holes are formed.

11. The cover plate of claim 10 wherein the main body includes a sloped mounting surface in which the second mounting holes are formed and which is inclined with respect to the base plane.

12. The cover plate of claim 5 further including means for rotatably mounting the cover plate to a conventional junction box such that the cover plate can be angularly adjusted relative to the junction box.

13. The cover plate of claim 12 wherein the mounting means includes a mounting bracket for mounting to the junction box and a screw rotatably journaled in the main body and which threadably engages a threaded opening in the mounting bracket.

14. A cover plate for lighting fixtures comprising:

a) A base having a base plane for selectively mounting on a wall or on a ceiling;

b) a main body connected to the base including:

(1) a central section; and (2) a pair of side sections disposed on opposite sides of the central section;

c) a planar mounting surface formed in the central section of the main body generally parallel to the base plane;

d) a pair of first mounting holes formed in the planar mounting surface arranged and configured to mount said lighting fixtures in ceiling mounting applications;

e) a sloped mounting surface on each side section which is disposed at a prescribed angle relative to the base plane; and f) a pair of second mounting holes formed in the sloped mounting surface of respective side sections arranged and configured to mount said lighting fixtures in wall mounting applications.

15. The cover plate of claim 14 wherein the sloped mounting surfaces are spherical.

16. The cover plate of claim 14 wherein the axis of the second mounting hole is disposed at approximately a 60° angle relative to the base plane.

17. The cover plate of claim 14 further including means for rotatably mounting the cover plate to a conventional junction box such that the cover plate can be angularly adjusted relative to the junction box.

18. The cover plate of claim 17 wherein the mounting means includes a mounting bracket for mounting to the junction box and a screw rotatably journaled in the main body and which threadably engages a threaded opening in the mounting bracket.

* * * * *

UNITED STATES PATENT AND TRADEMARK OFFICE

CERTIFICATE OF CORRECTION

PATENT NO. : 5,515,252

DATED : May 7, 1996

INVENTOR(S) : Mitchell M. Osteen et al.

It is certified that error appears in the above-indentified patent and that said Letters Patent is hereby corrected as shown below:

Column 5, line 4, "a lighting fixture" should read--lighting fixtures--.

Signed and Sealed this

Tenth Day of September, 1996

*Attest:*

*Attesting Officer*

BRUCE LEHMAN

*Commissioner of Patents and Trademarks*